US008568058B2

(12) United States Patent
Smieja

(10) Patent No.: US 8,568,058 B2
(45) Date of Patent: Oct. 29, 2013

(54) ELECTRIC SCREED HEAT CONTROL SYSTEM AND METHOD OF HEATING SCREED PLATES

(75) Inventor: Jameson M. Smieja, Brooklyn Park, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 12/900,021

(22) Filed: Oct. 7, 2010

(65) Prior Publication Data

US 2012/0087726 A1 Apr. 12, 2012

(51) Int. Cl.
*G05D 23/22* (2006.01)

(52) U.S. Cl.
USPC ..... 404/84.05; 404/79; 404/118

(58) Field of Classification Search
CPC ..... E01C 23/14
USPC ..... 404/75, 77, 79, 118, 84.05; 700/299, 700/300
See application file for complete search history.

(56) References Cited

U.S. PATENT DOCUMENTS

| | | | | |
|---|---|---|---|---|
| 5,397,199 | A | 3/1995 | Frampton et al. | |
| 5,556,225 | A * | 9/1996 | Marino | 404/77 |
| 5,556,226 | A * | 9/1996 | Hohmann, Jr. | 404/84.1 |
| 5,568,992 | A | 10/1996 | Grembowicz et al. | |
| 6,227,762 | B1 * | 5/2001 | Van Velsor | 404/95 |
| 6,334,735 | B1 * | 1/2002 | Williams et al. | 404/79 |
| 6,530,720 | B1 * | 3/2003 | Green | 404/84.1 |
| 6,981,820 | B2 | 1/2006 | Nelson | |
| 7,217,062 | B2 | 5/2007 | Pisano et al. | |
| 7,427,174 | B2 | 9/2008 | Dearing | |
| 7,559,718 | B2 * | 7/2009 | Zachman et al. | 404/84.5 |
| 7,641,419 | B1 | 1/2010 | Nelson | |
| 2008/0292401 | A1 * | 11/2008 | Potts | 404/95 |
| 2011/0123269 | A1 * | 5/2011 | Lutz | 404/118 |

* cited by examiner

*Primary Examiner* — Raymond W Addie
(74) *Attorney, Agent, or Firm* — Miller, Matthias & Hull

(57) ABSTRACT

In electrically heated screed assemblies, elements that are prone to failure are the temperature sensors. Typically, each screed plate has a single temperature sensor. When one temperature sensor fails, the controller will look for a working temperature sensor amongst the other screed plates and if more than one temperature sensor is working, the controller will choose the most relevant temperature sensor and use the data from the working temperature sensor to operate the resistive heating elements on the screed plate with the non-functional temperature sensor. If the temperature sensor on an outer screed plate fails, the controller will look to the other outer screed plate temperature sensor for data for purposes of operating the resistive heating elements on the outer screed plate with a broken temperature sensor. Similarly, if the temperature sensor on an inner or central screed plate fails, the controller will look to a neighboring screed plate with a working temperature sensor for data for purposes of operating the inner or center screed plate with the broken temperature sensor. The controller will generate signals for the operator to replace the failed temperature sensor.

20 Claims, 3 Drawing Sheets

ELECTRIC SCREED HEAT CONTROL SYSTEM AND METHOD OF HEATING SCREED PLATES

TECHNICAL FIELD

This disclosure relates to asphalt paving machines, and more particularly to an electrically heated screed assembly for asphalt paving machines. Still more specifically, this disclosure relates to a heat control system and related heating method for a screed assembly of an asphalt-paving machine.

BACKGROUND OF THE RELATED ART

The laying of asphalt paving material on road surfaces involves the spreading of paving material that consists of a heated aggregate filled bituminous mixture on a prepared roadbed. The paving material is spread while hot and is then compacted so that upon cooling a hardened pavement surface is formed. Conventional paving machines utilize a heavy assembly, termed a "screed", which is drawn behind the paving machine. The screed typically includes four replaceable screed plates that are constructed of a suitable steel, to spread a smooth even layer of paving material on the prepared roadbed. The weight of the screed assembly aids to compress the paving material and perform initial compaction of the paving material layer. screed assemblies can include vibratory mechanisms placed directly on the screed plates or separate vibratory tamper bars connected in tandem with the screed plates to aid in the initial compaction of the paving material.

To facilitate a proper deposition of the paving material, the screed plates are typically heated, to a temperature in the range of from about 82° to about 171° C. (180° to 340° F.). Heating the screed plates assists the paving material in flowing under the screed plates and reduces adhesion of the paving material to the screed plates. If the screed plates are not adequately heated, the bituminous mixture contacts the bottom of the screed plate and begins to harden, resulting in buildup of paving material and excessive drag. If the temperature is too high, the screed plates may warp, the heated paving material may be damaged or components associated with the screed plates may be damaged. Generally, screed plates are heated to a temperature close to the temperature of the heated asphalt material.

Some conventional screed assemblies are commonly heated by fossil fuel powered burners that heat the upper surface of the screed plate by the direct application of flame or hot exhaust gases. The use of fossil fuel burners to heat screeds has drawbacks. For example, the combustion of fossil fuels generates smoke that represents a source of environmental pollution, and creates a poor working environment for the paving workers. Further, because the flames or exhaust gases of the burners actually contact the surfaces of the screed plates, warping may result. The contours of the screed plates determine the quality, evenness or smoothness of the paving material that is being laid down. While screed plates are often flexed under extreme tensile loads during use to achieve desired crowning or other surface contours, warping of a screed plate can render it useless.

Elastomeric electrically powered heating pads positioned on the upper surface of the screed plates with layers of insulation placed on top of the heating pads have also been used. A heavy steel grid member is placed on top of the insulation to hold the heating pads and insulation in place. However, the elastomeric material typically has poor resistance to tear, abrasion, and poor to fair resistance to fluids such as oil, gasoline and solvents. Additionally, this design requires loose components placed on top of one another to maintain full contact of the heating pads with the screed plates.

Other more sophisticated electric heating systems for screed plates are available. Typically, these heating systems are electric and include temperature sensors, which are used in a feedback control system to maintain the screed plates at the appropriate temperature or within the appropriate temperature range. One problem associated with this design is the tendency for temperature sensors to fail from time to time. On many systems, the user can bypass the temperature sensor and heat the screed plate in an open-loop configuration until a repair can be made. In short, the user removes or bypasses the temperature sensor to override the system thereby enabling the user to continue to pave. However, removing or by passing a temperature sensor can lead to potential overheating of certain components in the system beyond the allocated design limits. As a result, repairs in addition to replacement of the failed temperature sensor may be needed. Further, the manual override technique may raise certain warranty issues, particularly if components unrelated to the screed plate heating system are damaged by the excessive heat.

SUMMARY OF THE DISCLOSURE

In one aspect, a heating control system for a screed is disclosed. The screed includes a plurality of screed plates including first and second screed plates. The heating control system includes a controller, a first screed plate and a second screed plate. The first screed plate may be coupled to a first temperature sensor and at least one first heating element. The first temperature sensor and at least one first heating element may be linked to the controller. The at least one first heating element may heat the first screed plate under control of the controller, according to a first algorithm and using input signals from the first temperature sensor. The second screed plate may be coupled to a second temperature sensor and at least one second heating element. The second temperature sensor and the at least one second heating element may be linked to the controller. The at least one second heating element may heat the second screed plate under control of the controller, according to a second algorithm and using input signals from the second temperature sensor. If the first temperature sensor fails, the controller may operate the at least one first heating element according to the second algorithm and using input signals from the second temperature sensor. Similarly, the second temperature sensor fails, the controller may operate the at least one second heating element according to the first algorithm and using input signals from the first temperature sensor.

In another aspect, an asphalt-paving machine is disclosed that includes a screed assembly including first and second screed plates. The screed assembly is equipped with a heating control system that may include a controller. The first screed plate may be coupled to a first temperature sensor and at least one first heating element. The first temperature sensor and at least one first heating element may be linked to the controller. The at least one first heating element may heat the first screed plate under control of the controller, according to a first algorithm and using input signals from the first temperature sensor. The second screed plate may be coupled to a second temperature sensor and at least one second heating element. The second temperature sensor and at least one second heating element may be linked to the controller. The at least one second heating element may heat the second screed plate under control of the controller, according to a second algorithm and using input signals from the second temperature sensor. If the first temperature sensor fails, the controller may operate the at least one first heating element according to the second algorithm and using input signals from the second temperature sensor. Similarly, if the second temperature sensor fails, the controller may operate the at least one second heating element according to the first algorithm and using input signals from the first temperature sensor.

In another aspect, a method for heating a screed of an asphalt-paving machine is disclosed. The screed includes a plurality of screed plates including a first screed plate and a second screed plate. The disclosed method may include coupling the first screed plate to a first temperature sensor and at least one first heating element. The method may further include coupling the second screed plate to a second temperature sensor and at least one second heating element. The method may further include operating the at least one first heating element to heat the first screed plate according to a first algorithm and using signals generated by the first temperature sensor. The method may further include operating the at least one second heating element to heat the second screed plate according to a second algorithm and using signals generated by the second temperature sensor. The method may further include, in the event the first temperature sensor fails, operating the at least one first heating element according to the second algorithm and signals generated by the second temperature sensor. Similarly, the method may further include, in the event the second temperature sensor fails, operating the at least one second heating element according to the first algorithm and signals generated by the first temperature sensor.

In accordance with any one or more of the aspects described above, the at least one first heating element may include from 1 to about 6 first heating elements.

In accordance with any one or more of the aspects described above, the at least one second heating element may include from 1 to about 6 second heating elements.

In accordance with any one or more the aspects described above, the screed may further include a third screed plate and the system may further include a third temperature sensor and at least one third heating element coupled to the third screed plate. The third temperature sensor and at least one third heating element may be linked to the controller. The at least one third heating element may heat the third screed plate under control of the controller, according to a third algorithm and using input signals from the third temperature sensor. In the event the first and/or second temperature sensors fail, the controller may operate the at least one first heating element and/or the at least one second heating element according to the third algorithm and using input signals from the third temperature sensor. Similarly, if the third temperature sensor fails, the controller may heat the third heating elements using the first or second algorithm and the first or second sensor.

In accordance with any one or more of the aspects described above, the at least one third heating element may include from 1 to about 6 third heating elements.

In accordance with any one or more the aspects described above, the screed may include a fourth screed plate. The system may further include a fourth temperature sensor and at least one fourth heating element that maybe coupled to the fourth screed plate. The fourth temperature sensor and at least one fourth heating element may be linked to the controller. The at least one fourth heating element may heat the fourth screed plate under control of the controller, according to a fourth algorithm and using input signals from the fourth temperature sensor. In the event the first, second and/or third temperature sensors fail, the controller may operate, as needed, any one or more of the at least one first heating element, the at least one second heating element and/or the at least one third heating element according to the fourth algorithm and using input signals from the fourth temperature sensor. Of course, as will be apparent to those skilled in the art, in the event the fourth temperature sensor fails, the at least one fourth heating element may be operated by controller using any one of the first, second or third algorithms and first, second or third temperature sensors.

In accordance with any one or more the aspects described above, the at least one fourth heating element may include from 1 to about 6 fourth heating elements.

In accordance with any one or more the aspects described above, in the event all temperature sensors fail, the disclosed system, disclosed paving machine or disclosed method may operate any one or all of the heating elements according to a limited open loop algorithm that prevents the screed plates from reaching temperatures in excess of a predetermined upper limit.

In accordance with any one or more the aspects described above, a predetermined upper limit for screed plate temperature may be about 175° C. (347° F.).

In accordance with any one or more of the aspects described above, the algorithms may be the same, similar or very different. For example, the algorithms for the outer or extension screed plates may be the same or similar and but may be different than the algorithms for the inner or center screed plates. Heating algorithms may also vary depending upon screed plate geometry, the type of temperature sensor utilized, the position of the temperature sensor and the number of temperature sensors used per screed plate.

DETAILED DESCRIPTION

Figure 1:
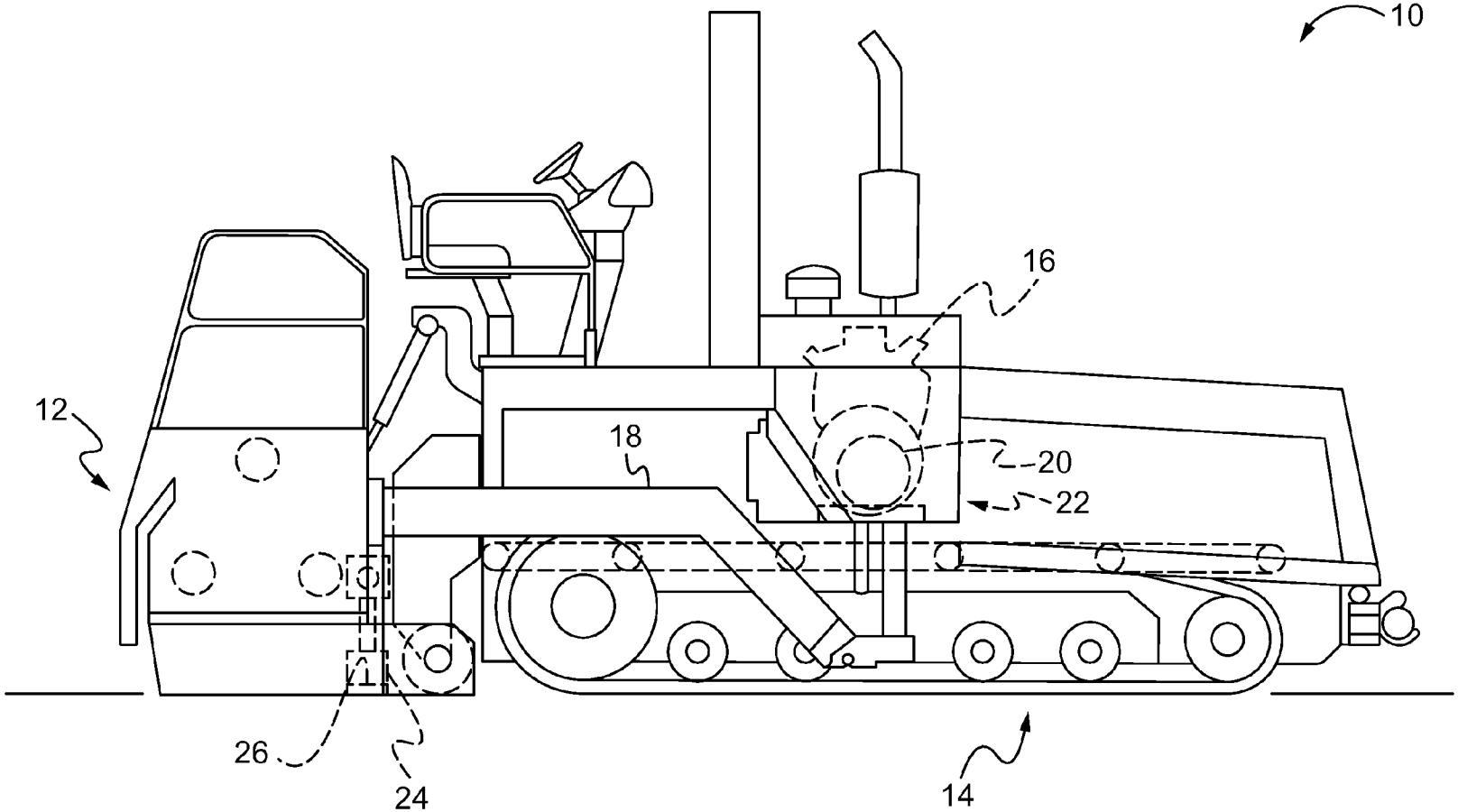
FIG. 1 is a diagrammatic side view of an asphalt paving machine towing a disclosed screed assembly.

Referring to FIG. 1 an asphalt paving machine 10 is shown with a screed assembly 12 attached to the back thereof. The asphalt paving machine 10 is supported by a propelling arrangement 14, in this case a track undercarriage 14, which may be driven by an engine 16 in a known manner. The screed assembly 12 is connected to the machine 10 by a pair of tow bars 18, one of which is shown in FIG. 1. The machine 10 may also include a generator 20 and electric power supply 22, which will be discussed in detail below in connection with the heating of the screed assembly 12. An optional tamper bar is shown at 24 with one or more optional electric heaters are shown at 26.

Figure 2:
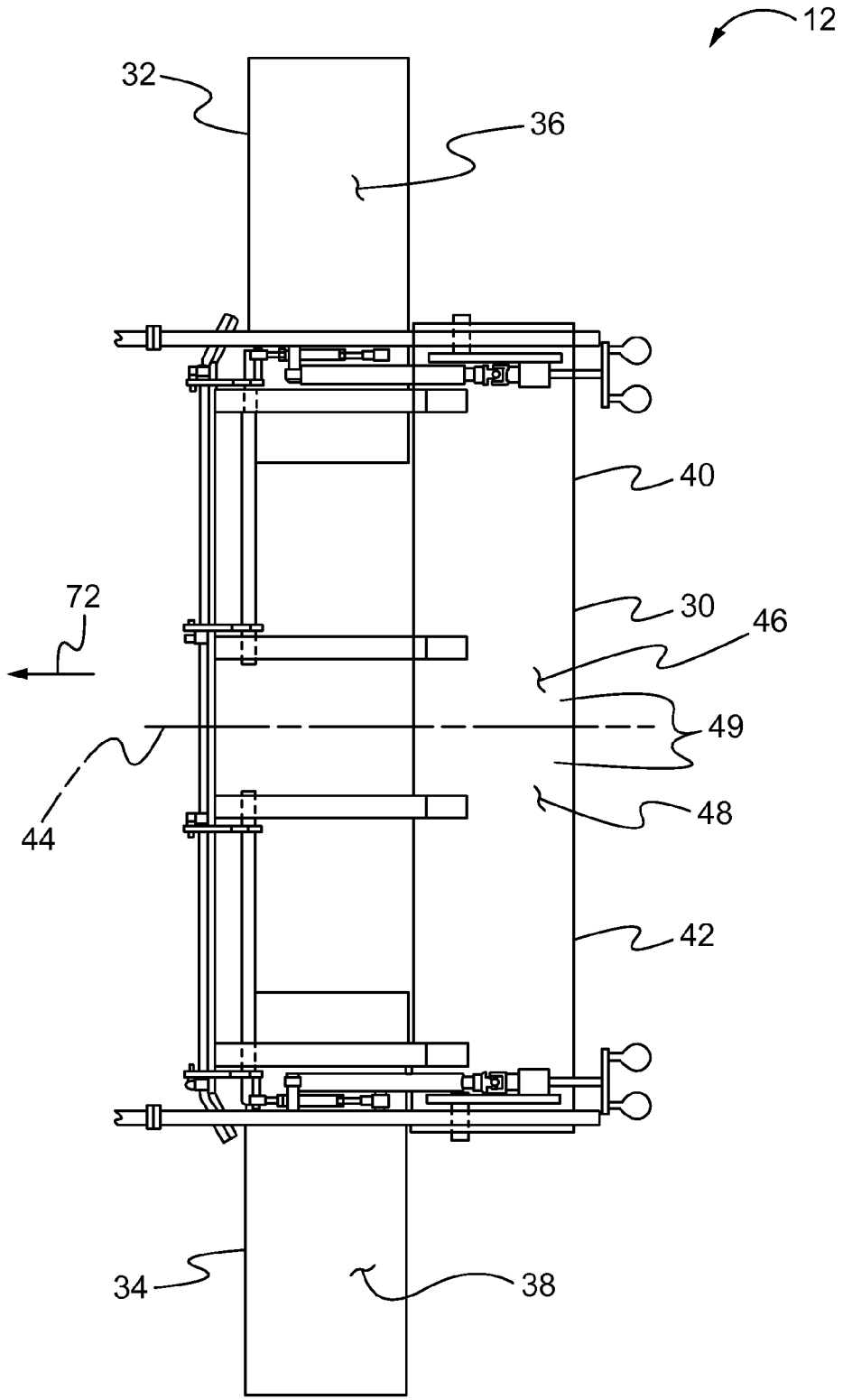
FIG. 2 is a top plan view of a disclosed screed assembly as told by an asphalt paving machine.
Figure 3:
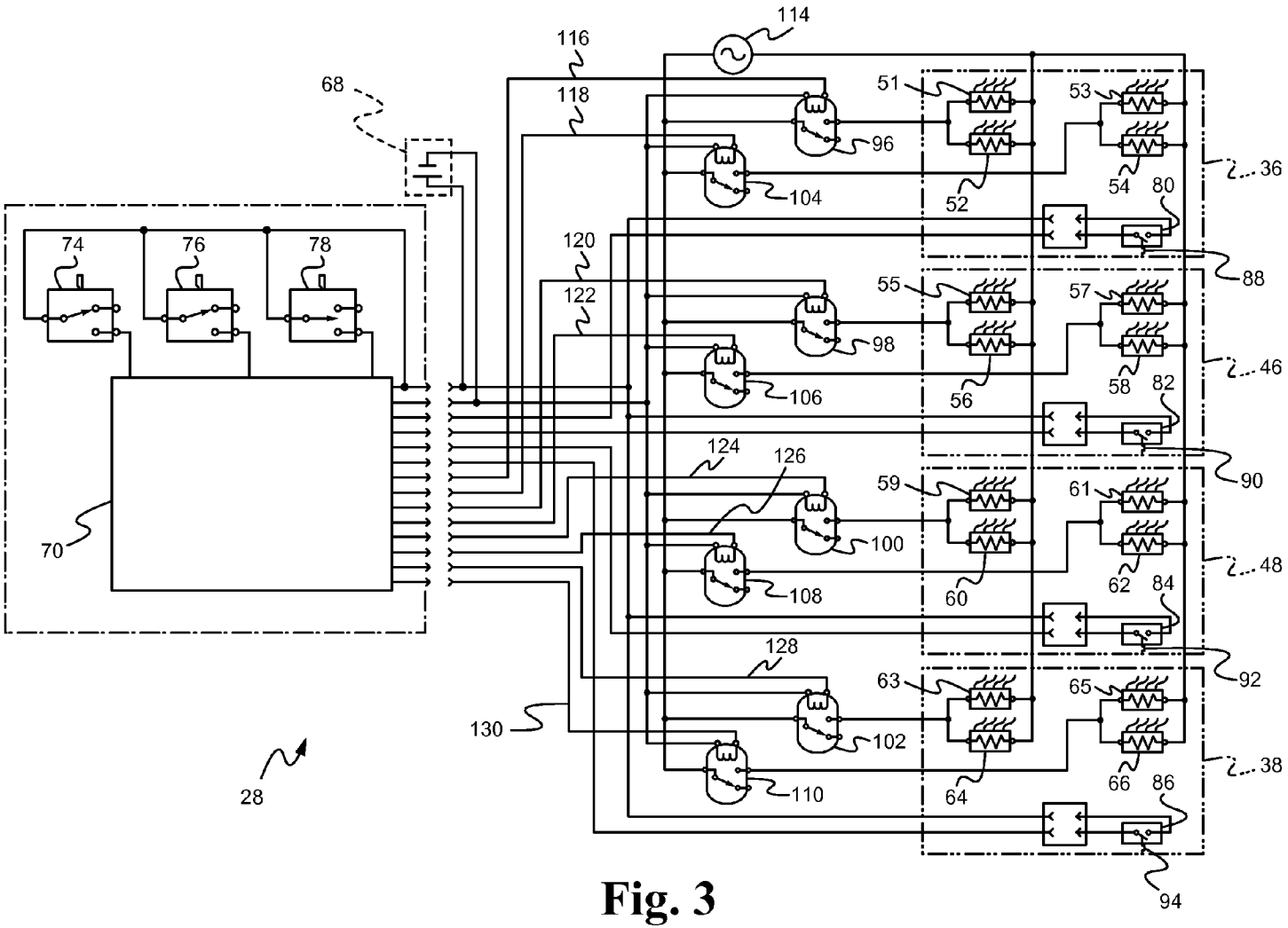
FIG. 3 is a schematic illustration of a disclosed screed heating control system.

The screed assembly 12 for the paving machine 10 is shown in detail in FIG. 2. The paving machine 10 includes a heating control system that is shown in FIG. 3. Returning to FIG. 2, the screed assembly 12 includes a main screed 30 and screed extensions 32, 34. It should be understood that screed extensions 32, 34 are shown as being front mounted but can be either front or rear mounted extensions. In an extended mode, the screed extensions 32, 34 extend outwardly from either side of the main screed 30. For purposes of this disclosure, the screed extensions 32, 34 may include separate screed plates, or a screed plate 36 and a separate screed plate 38.

The main screed 30 is made up of first and second sections 40, 42 one on each side of a longitudinal central axis 44. The screed extensions 32, 34 are slidably mounted to first and second sections 40, 42 of the main screed 30 respectively. The main screed 30 and first and second sections 40, 42 may include first and second screed plates 46, 48 or alternatively only a single screed plate 49. Thus, the main screed 30 includes three or four screed plates including the screed plate 36, the screed plate 38, the first or left-center screed plate 46 and the second or right-center screed plate 48 or, alternatively a single screed plate 49.

The screed assembly 12 functions to spread paving material distributed by the paving machine 10 onto a roadbed. In order to achieve optimum workability of the paving material, the temperature of the screed plates 36, 38, 46, 48 should be maintained within a predetermined temperature range. This predetermined temperature range is, for exemplary purposes, between about 250 and about 310° F. (121-154° C.), however, other temperature ranges may be used, depending upon the paving material, weather, etc. The heating control system 28 automatically controls the temperature of screed plates 36, 38, 46, 48 as illustrated in detail in FIG. 3.

The heating control system 28 includes resistive heating elements 51-66, an electrical power supply 68 and a controller 70. The power supply 68 is any suitable AC or DC power source that is coupled to the controller 70. The power supply 68 shown in FIG. 3, utilizes a 24V DC power supply, but other voltages and power sources may be used, as would be known in the art. The controller 70 may include a typical microprocessor and memory, and can be programmed or hard-wired to provide the functions discussed below.

As illustrated in FIG. 3, groups of four resistive heating elements 51-54, 55-58, 59-62 and 63-66 may be disposed on each screed plate 36, 46, 48, 38 respectively. However, this disclosure is not limited to this construction and other numbers of resistive heating elements may be provided for each screed plate. For example, as few as one heating element or as many as six or more may be used on each screed plate 36, 46, 48, 38.

The resistive heating elements 51, 52, 55, 56, 59, 60.63, 64 are disposed on forward portions of the screed plates 36, 46, 48, 38 respectively and the resistive heating elements 53, 54, 57, 58, 61, 62, 65, 66 are disposed on rearward portions of the screed plates 36, 46, 48, 38 respectively. As used herein throughout, forward refers to the side of the screed plate that is closest in proximity to the paving machine 10, while rearward refers to the farthest away from the paving machine 10. In use, the screed assembly 12 is pulled in the forward direction as indicated by arrow 72 in FIG. 2.

The heating control system 28 also includes inputs to and outputs from the controller 70. An on/off switch 74, a both/rear-only switch 76 and a warm-up switch 78 provide one set of inputs. Each of the switches 74, 76 and 78 may selectively connect the electrical power supply 60 to respective input connectors of the controller 70. Temperature switches, such as those shown at 80, 82, 84, 86, may be used or the controller 70 may receive temperature data directly from one or more temperature sensors 88, 90, 92, 94.

The optional warm-up switch 78 may be activated if it is desirable to heat more than screed plate 36, 46, 48, 38 simultaneously. Such simultaneous heating may be desirable during initial start up of the paving machine 10. When the warm-up switch 78 is activated, the controller 70 may turn on all the outputs switches 96, 98, 100, 102, 104, 106, 108, 110 at the same time. Once the screed plates 36, 46, 48, 38 have reached their predetermined temperatures, the controller 70 returns to automatic mode, which may include separate algorithms for each screed plate 36, 46, 48, 38, or common algorithms for the screed plates 36, 38 and common algorithms for the screed plates 46, 48. In short, the controller 70 may employ a single heating algorithm or a plurality of heating algorithms. The algorithms may vary depending upon screed plate geometry as well as the placement of the temperature sensor on a screed plate and type of sensor utilized. Separate algorithms for each plate are foreseeable.

In addition, the optional warm-up switch 78 may override the automatic mode. Thus, when the automatic mode is not providing the type of surface finish desired, due to inadequate heating, the warm up mode can be activated. After all the temperature switches open once, the controller 70 may go back to the automatic mode. Alternatively, the warm-up mode may be manually controlled. For example, the warm-up switch 78 also can act as an override for the warm-up mode. Thus, if the operator determines that the appropriate surface finish is being achieved, the warm-up switch 78 can be operated again, and the controller 70 will go back to automatic mode.

Temperature sensors 88, 90, 92, 94 may be provided to detect the temperature of the corresponding screed plate 36, 46, 48, 38. If used, the temperature switches 80, 82, 84, 86 will close when the detected temperature falls below a first predetermined temperature $T_a$, e.g., $T_a$=250° F. (121° C.), and will open when the temperature reaches a second predetermined temperature $T_b$, e.g., $T_b$=310° F. (154° C.). Otherwise, the sensors 88, 90, 92, 94 may communicate with the controller 70 directly.

As shown in FIG. 3, eight outputs (116, 118, 120, 122, 124, 126, 128, 130) from the controller 70 are provided respectively to eight solenoid relay switches 96, 104, 98, 106, 100, 108, 102, 110, i.e., four forward output switches 96, 98, 100, 102 and four rearward output switches 104, 106, 108, 110. Two forward and rearward output switches (96/104, 98/106; 100/108, 102/110) are assigned to each respective screed plate 46, 46, 48, 38 (FIG. 2). The output switches are normally open, but the output switches close in response to signals provided from the controller 70. When closed, the output switches connect an AC power generator 114 to the respective resistive heating elements such as 51-54, 55-58, 59-62 and 63-66, thus selectively heating the screed plates 36, 46, 48, 38 in response to the temperature being below a threshold temperature $T_a$. Similarly, when the temperature at one of the sensors 88, 90, 92, 94 increases above the second threshold temperature $T_b$, the closed switch opens and AC power is disconnected from the heating elements 51-54, 55-58, 59-62, 63-66 disposed on the screed plate 36, 46, 48, 38 with the temperature sensor 88, 90, 92, 94 that is signaling a temperature in excess of $T_b$.

Each temperature switch 80, 82, 84, 86 controls two corresponding output switches of its associated screed plate 36, 46, 48, 38. As shown in FIG. 3, the temperature switch 80 corresponds to the forward and rearward output switches 96, 104 of the screed plate 36. The forward output switch 96 corresponds to the forward resistive heating elements 51, 52 and the rearward output switch 104 corresponds to the rearward resistive heating elements 53, 54. Thus, the heating of the forward and rearward resistive heating elements 51, 52, 53, 54 on the screed plate 36 is separately controlled by the two respective output switches 96, 104. Similarly, temperature switches 82, 84, 86, associated with the screed plates 46, 48, 38, control the associated forward and rearward output switches 98/106, 100/108, 102/110 respectively and the associated front and rear heating elements 51-54, 55-58, 59-62, 63-66 respectively.

The both/rear only switch 76 distinguishes the forward outputs 96, 98, 100, 102 from the rearward outputs 104, 106, 108, 110. When the both/rear only switch 77 is off, i.e., "both" is activated, all outputs, forward 96, 98, 100, 102 and rearward 104, 106, 108, 110 are enabled. However, when the both/rear-only switch 76 is on, i.e., "rear-only" is activated, only the rear output switches 104, 106, 108, 110 can be closed. For example, if the rear-only switch 76 is on, only the temperature switch 104 for the screed plate 36 can close, and thus only the rearward resistive heating elements 51, 52 associated with the temperature switch 104 are energized accordingly. This feature provides for a more efficient use of the power supply 68 under certain conditions. Namely, those conditions are where only the rearward portion of the screed plate needs to be heated, making it inefficient to energize the forward resistive heating elements. This condition may be preferred due to the manner in which the heated asphalt material interacts with the screed plates. For instance, when the asphalt material is first conveyed from the paving machine 10 onto the roadbed it has a high temperature. This high temperature asphalt contacts the front portions of the screed plates 36,46,48,38, and then reaches the back portions of the screed plates 36,46,48,38 as the screed assembly 12 travels over the asphalt material. However, the temperature of the asphalt material lowers by the time it reaches the back portions of the screed plates 36,46,48,38. Thus, the rear portions of the screed plates 36,46,48,38 are not as influenced by the heated temperatures of the asphalt material, as compared to the front portions of the screed plates 36,46,48,38. Thus, under certain conditions, it may be desirable to use algorithms that energize the rearward resistive elements only in order to conserve power of the paving machine 10.

Typically, the elements that are prone to failure are the temperature sensors 88, 90, 92, 94. In accordance with this disclosure, if the temperature sensor 88 fails, manual override is not necessary to keep the screed plate 36 hot. Instead, the controller 70 will send signals to the forward and rearward output switches 96, 104 to activate the heating elements 51-54 based upon the signals generated from the neighboring temperature sensor 90 or the screed plate sensor 94 and using a control algorithm that may be used for the heating elements 55-58 of the neighboring screed plate 46 or a control algorithm that may be used for the screed plate heating elements 63-66.

In short, if a temperature sensor, such as any of the temperature sensors 88, 90, 92, 94 fail, and at least one temperature sensor 88, 90, 92, 94 remains working, the controller 70 will use the data from a working sensor 88, 90, 92 or 94 to supply signals through the forward and rearward output switches to the heating elements of the screed plate with the failed temperature sensor. Using this technique, only a single temperature sensor 88, 90, 92, 94 needs to be working for the heating control system 28 to remain functional.

The controller 70 will generate signals for the operator to replace the failed temperature sensor(s). In one aspect, because the heating algorithms for the inner screed plates 46, 48 may be similar, if not the same, if the temperature sensor 90 of the screed plate 46 fails, and the temperature sensor 92 of the adjacent inner screed plate 48 remains functional, the controller may use the data from the sensor 92 and the algorithm screed for plate 48 to operate the heating elements 55-58 of the screed plate 46. In another aspect, because the heating algorithms of the outer screed plates 36, 38 may be similar, if not the same, if the temperature sensor 88 of the screed plate 36 fails, and the temperature sensor 94 of the screed plate 38 remains functional, the controller may use the data from the sensor 94 and the algorithm for screed plate 38 to operate the heating elements 51-54 of the screed plate 36.

In one aspect, manual override is no longer permitted thereby eliminating the operator's ability to heat the screed assembly 12 beyond validated limits, which could jeopardize the functionality of other components. By utilizing working sensors on screed plates to provide a heating algorithm for a screed plate with a broken or failed sensor, the danger of an equipment operator intentionally or unintentionally overheating all or part of a screed assembly and its associated components is avoided.

INDUSTRIAL APPLICABILITY

In operation, the on/off switch on the controller selectively connects the 24V power supply to the controller. When the on/off switch is positioned in an ON position, an automatic mode of the heating control system is initiated. In the automatic mode, the controller may programmed to limit the number of plates or sections that can be activated at a time. For example, only one of two output switches that control heaters on the middle screed plates or the outside screed plates is on at a time. Moreover, the controller can be programmed to allow only one of the output switches that control forward or rearward heaters of both the outer and inner screed plates to be on at one time. The controller may be programmed to activate the heaters of only one outer screed plate or only one inner screed plate at a time. Cyclic, periodic and even random patterns of activating the heating elements are all possible portions of the heating algorithms. Separate heating algorithms may be provided for each screed plate. This control can be variably programmed to have one or more, but fewer than all of the heaters to be on at a time, as would be understood by one skilled in the art.

During normal operation, the screed plates will cool down and the temperature sensors detect the temperature drop. The controller receives signals from the temperature sensor and that the corresponding screed plate should be heated. The controller may then energize the resistive heating element or elements corresponding to that screed plate.

As noted above, elements that are prone to failure are the temperature sensors. In one aspect of this disclosure, each screed plate has a single temperature sensor. However, screed plates with multiple temperature sensors or redundant temperature sensors may be utilized within the scope of this disclosure. In accordance with this disclosure, if one temperature sensor fails, manual override is not necessary to keep the associated screed plate hot. Instead, the controller will look for a working temperature sensor and if more than one temperature sensor is working, the controller will choose the most relevant temperature sensor and use the data from the working temperature sensor to operate the resistive heating elements on the screed plate with the non-functional temperature sensor. Thus, if the temperature sensor on an outer screed plate fails, the controller will look to the other outer screed plate temperature sensor for data for purposes of operating the resistive heating elements on the outer screed plate with a broken temperature sensor. Similarly, if the temperature sensor on an inner or central screed plate fails, the controller will look to a neighboring screed plate with a working temperature sensor for data for purposes of operating the screed plate with the broken temperature sensor. Using these techniques, only a single temperature sensor needs to be working for the heating control system to remain functional. The controller may generate signals for the operator to replace the failed temperature sensor(s).

In one aspect, manual override is no longer permitted thereby eliminating the operator's ability to heat the screed assembly beyond validated limits, which could jeopardize the functionality of other components. By utilizing working sensors on screed plates to provide a heating algorithm for a screed plate with a broken or failed sensor, the danger of an equipment operator intentionally or unintentionally overheating a screed plate, a screed assembly and its related components is avoided.

What is claimed is:

1. A heating control system for a screed, the screed including a plurality of screed plates including first and second screed plates, and a plurality of temperature sensors, each temperature sensor coupled to one of the plurality of screed plates, the heating control system comprising:

a controller;

the first screed plate coupled to a first temperature sensor and at least one first heating element, the first temperature sensor and at least one first heating element being linked to the controller, the at least one first heating element heating the first screed plate under control of the controller and according to a first algorithm; and the second screed plate coupled to a second temperature sensor and at least one second heating element, the second temperature sensor and at least one second heating element being linked to the controller, the at least one second heating element heating the second screed plate under control of the controller and according to a second algorithm;

wherein if the first temperature sensor fails, the controller selects a sensor signal corresponding to another temperature sensor operating with a similar heating algorithm as the failed first temperature sensor and the controller uses data from the another temperature sensor to operate the at least one first heating element according to the similar heating algorithm.

2. The system of claim 1 wherein the at least one first heating element includes from 1 to about 6 first heating elements.

3. The system of claim 1 wherein the second temperature sensor is the another temperature sensor.

4. The system of claim 1 wherein the screed further includes a third screed plate, the system further including a third temperature sensor and at least one third heating element coupled to the third screed plate, the third temperature sensor and at least one third heating element being linked to the controller, the at least one third heating element heating the third screed plate under control of the controller and according to a third algorithm;

wherein if the first and second temperature sensors fail, corresponding signals are sent to the controller and the controller uses data from the third temperature sensor to operate the at least one first heating element and the at least one second heating element according to the third algorithm.

5. The system of claim 4 wherein the at least one third heating element includes from 1 to about 6 third heating elements.

6. The system of claim 4 wherein the screed includes a fourth screed plate, the system further including a fourth temperature sensor and at least one fourth heating element coupled to the fourth screed plate, the fourth temperature sensor and at least one fourth heating element being linked to the controller, the at least one fourth heating element heating the fourth screed plate under control of the controller and according to a fourth algorithm;

wherein if the first, second and third temperature sensors fail, corresponding signals are sent to the controller and the controller uses data from the fourth temperature sensor to operate the at least one first heating element, the at least one second heating element and the at least one third heating element according to the fourth algorithm.

7. The system of claim 6 wherein the at least one fourth heating element includes from 1 to about 6 fourth heating elements.

8. An asphalt-paving machine comprising:

a plurality of screed plates including first and second screed plates and a plurality of temperature sensors, each temperature sensor coupled to one of the plurality of screed plates;

a heating control system including a controller;

the first screed plate coupled to a first temperature sensor and at least one first heating element, the first temperature sensor and at least one first heating element being linked to the controller, the at least one first heating element heating the first screed plate operate under control of the controller and according to a first algorithm;

the second screed plate coupled to a second temperature sensor and at least one second heating element, the second temperature sensor and at least one second heating element being linked to the controller, the at least one second heating element heating the second screed plate operate under control of the controller and according to a second algorithm;

wherein if the first temperature sensor fails, a corresponding signal is sent to the controller and the controller uses data from the second temperature sensor to operate the at least one first heating element according to the second algorithm; and wherein a single working one of the plurality of temperature sensors is needed for the heating control system to remain functional such that the controller automatically uses data from the working one of the plurality of temperature sensors to operate in place of a failed one of the plurality of temperature sensors.

9. The machine of claim 8 wherein the at least one first heating element includes from 1 to about 6 first heating elements.

10. The heating control system of claim 1, wherein the controller comprises a function that disables manual override of the screed heating control system when alternate sensor data is available, whereby an operator is blocked from manual control of the heating control system when the controller has sufficient data to operate the heating control system.

11. The machine of claim 8 wherein the screed further includes a third screed plate, the system further including a third temperature sensor and at least one third heating element coupled to the third screed plate, the third temperature sensor and at least one third heating element being linked to the controller, the at least one third heating element heating the third screed plate under control of the controller and according to a third algorithm;

wherein if the first and second temperature sensors fail, corresponding signals are sent to the controller and the controller uses data from the third temperature sensor to operate the at least one first heating element and the at least one second heating element according to the third algorithm.

12. The machine of claim 11 wherein the at least one third heating element includes from 1 to about 6 third heating elements.

13. The machine of claim 11 wherein the screed includes a fourth screed plate, the system further including a fourth temperature sensor and at least one fourth heating element coupled to the fourth screed plate, the fourth temperature sensor and at least one fourth heating element being linked to the controller, the at least one fourth heating element heating the fourth screed plate under control of the controller and according to a fourth algorithm;

wherein if the first, second and third temperature sensors fail, corresponding signals are sent to the controller and the controller uses data from the fourth temperature sensor to operate the at least one first heating element, the at least one second heating element and the at least one third heating element according to the fourth algorithm.

14. The system of claim 13 wherein the at least one fourth heating element includes from 1 to about 6 fourth heating elements.

15. A method for heating a screed of an asphalt-paving machine, the screed including a plurality of screed plates including a first screed plate and a second screed plate, and a plurality of temperature sensors, each temperature sensor coupled to one of the plurality of screed plates, the method comprising:

coupling the first screed plate to a first temperature sensor and at least one first heating element;

coupling the second screed plate to a second temperature sensor and at least one second heating element;

operating the at least one first heating element to heat the first screed plate according to a first algorithm executed at a controller and signals generated by the first temperature sensor;

operating the at least one second heating element to heat the second screed plate according to a second algorithm executed at the controller and signals generated by the second temperature sensor;

wherein if the first temperature sensor fails, selecting, at the controller, a sensor signal corresponding to another temperature sensor operating with a similar heating algorithm as the failed first temperature sensor;

sending a corresponding signal to the controller and the controller using data from the second temperature sensor to operate the at least one first heating element according to the similar heating algorithm and signals generated by the another temperature sensor.

16. The method of claim 15 wherein the screed further includes a third screed plate, the method further including:

coupling a third temperature sensor and at least one third heating element to the third screed plate;

operating the at least one third heating element according to a third algorithm and signals generated by the third temperature sensor;

wherein if the first and second temperature sensors fail, sending corresponding signals to the controller and the controller using data from the third temperature sensor to operate the at least one first heating element and the at least one second heating element according to the third algorithm and signals generated by the third temperature sensor.

17. The method of claim 16 wherein the screed further includes a fourth screed plate, the method further including:

coupling a fourth temperature sensor and at least one fourth heating element to the fourth screed plate;

operating the at least one fourth heating element according to a fourth algorithm and signals generated by the fourth temperature sensor;

wherein if the first, second and third temperature sensors fail, sending corresponding signals to the controller and the controller using data from the fourth temperature sensor to operate the at least one first heating element, the at least one second heating element and the at least one third heating element according to the fourth algorithm and signals generated by the fourth temperature sensor.

18. The method of claim 15 wherein, in the event all temperature sensors fail, operating the at least one first heating element and the at least one second heating element according to a limited open loop algorithm that prevents the screed plates from reaching temperatures in excess of a predetermined upper limit.

19. The method of claim 18 wherein the predetermined upper limit is about 175° C. (347° F.).

20. The machine of claim 15 wherein the at least one first heating element and the at least one second heating element each include from 1 to 6 heating elements.

* * * * *